US005551531A

United States Patent [19]

Dumont

[11] Patent Number: 5,551,531

[45] Date of Patent: Sep. 3, 1996

[54] PURCHASE ITEM CHECKOUT STATION AND METHOD

[76] Inventor: Charles Dumont, 8925 Collins Ave., PH-E, Surfside, Fla. 33154

[21] Appl. No.: 321,798

[22] Filed: Oct. 12, 1994

Related U.S. Application Data

[63] Continuation-in-part of Ser. No. 241,354, May 11, 1994, Pat. No. 5,437,346.

[51] Int. Cl.[6] ..... A47F 10/02

[52] U.S. Cl. ..... 186/61; 186/66; 186/67

[58] Field of Search ..... 186/61, 66, 67, 186/68, 69

[56] References Cited

U.S. PATENT DOCUMENTS

| | | | |
|---|---|---|---|
| 3,538,311 | 11/1970 | Weidmann | 235/383 |
| 4,084,742 | 4/1978 | Silverman | 235/383 |
| 4,676,343 | 6/1987 | Humble et al. | 186/61 |
| 4,766,296 | 8/1988 | Barth | 235/383 |
| 4,909,356 | 3/1990 | Rimondi et al. | 186/61 |
| 4,912,906 | 4/1990 | Toner | 186/66 X |
| 5,013,896 | 5/1991 | Ono et al. | 235/381 |
| 5,115,888 | 5/1992 | Schneider | 186/61 |
| 5,167,301 | 12/1992 | Cappi et al. | 186/66 |
| 5,252,814 | 10/1993 | Tooley | 235/383 |
| 5,335,485 | 8/1994 | Cappi et al. | 186/66 X |

*Primary Examiner*—F. J. Bartuska
*Attorney, Agent, or Firm*—Oltman and Flynn

[57] ABSTRACT

An apparatus for pricing and bagging purchase items which are marked with bar codes includes a hub rotatably mounted on a hub mounting structure, a transparent and substantially horizontal upper table positioned over the lower table and rotatably mounted on the hub, the upper table having a circular array of purchase item delivery ports opening through the upper table, a transparent tray removably covering the purchase item delivery ports for receiving and retaining one the purchase item, a motor for rotating the upper table on the hub, a bar code scanner positioned beneath the upper table and directed upward, a plurality of bags individually designated for specific types of purchase items and positioned below one of the delivery ports for selectively receiving the purchase item, a tray tilting mechanism for tilting the tray to drop the purchase item from the tray through the port beneath the tray into one of the bags, a microprocessor for controlling the operation of the motor to rotate the upper table to pass the purchase item over the scanner to read the price and classification of the purchase item, and then for operating the motor to rotate the purchase item to a position directly above one of the bags designated for receiving purchase items of the classification of the purchase item, and for causing the tray tilting mechanism to drop the purchase item off the tray and through the port beneath the tray, into the particular bag, and for replacing the tray, and the method of using the apparatus.

7 Claims, 3 Drawing Sheets

PURCHASE ITEM CHECKOUT STATION AND METHOD

FILING HISTORY

This application is a continuation-in-part of application Ser. No. 08/241,354, filed on May 11, 1994 now U.S. Pat. No. 5,437,346.

BACKGROUND OF THE INVENTION

1. Field of the Invention

The present invention relates generally to the field of purchase item processing and checkout equipment. More specifically it relates to an automatic price reading and bagging apparatus including a rotatable, annular upper table and a fixed, circular lower table, a bar code scanner and a microprocessor. The upper table is horizontally mounted on spokes leading to a rotatable hub powered by an electric motor. The scanner is mounted within the lower table directly below a portion of the upper table, and the upper table is transparent so that scanner rays can pass through the upper table to read bar codes on purchase item. Bag holding chambers are recessed periodically around the perimeter of the top of the lower table and each chamber is lined with a purchase item carrying bag. Ports are provided periodically around the perimeter of the upper table which open into purchase item delivery funnels for delivering individual purchase items into the carrying bags. A transparent tray for holding a purchase item covers each port and the trays are removable from and tiltable relative to the port with a mechanical arm or equivalent tray moving means.

The method includes the steps of placing a single purchase item marked with a scanner bar code into one of the trays, while the upper table is rotated and to sequentially present each tray to the purchaser. The rotation of the upper table passes the purchase item over the scanner, which reads the price and description of the item and transmits this information to the micro-processor. Then the rotation of the upper table carries the tray and purchase item beyond the scanner and over the series of purchase bags, each bag being designated for receiving a specific type of purchase item. The micro-processor uses the scanned information about the purchase item to select which bag the item should enter, and powers the motor to rotate the upper table a sufficient number of degrees to place the purchase item directly above the appropriate bag. Then the tray is lifted and tilted by a mechanical arm or other means to drop the purchase item through the port beneath the item and into the appropriate bag. This process is continued until all purchase items for a given purchaser are priced and appropriately bagged. Then the purchaser pays the total price for the items, lifts the bags out of the chambers and carries them out of the store.

2. Description of the Prior Art:

There have recently been several checkout purchase item processing devices which are intended to accelerate the checkout process. These devices have generally been unequipped to automatically bag or bar code scan purchase items, and unequipped to sort purchase items for grouping by type. These device have also generally been unduly bulky and expensive to manufacture and maintain.

Such prior devices include Humble, U.S. Pat. No. 4,676,343, issued on Jun. 30, 1987, disclosing a self-service distribution system. Humble includes a tunnel through which purchase items are conveyed, but scanning is done by store employees before they enter the tunnel. Collins, U.S. Pat. No. 4,929,819, issued on May 29, 1990, revealing a method and apparatus for customer performed article scanning in self-service shopping. Collins includes a scanning module which is carried in a cart. Humble, U.S. Pat. No. 4,964,053, issued on Oct. 16, 1990, teaches a self-checkout of produce items. Humble processes both UPC identified articles and non-coded articles such as produce. Kohno, U.S. Pat. No. 5,195,613, issued on Mar. 23, 1993, discloses a commodity data reader including a bar code scanner on one side of an elongated counter. Purchase items pass for scanning across the scanning window. Kipp, U.S. Pat. No. 5,239,167, issued on Aug. 24, 1993, reveals a checkout system including a transmitter on each purchase item for transmitting product identifying information when activated. Humble, U.S. Pat. No. 4,792,018, issued on Dec. 20, 1988 teaches a system for security processing of retailed articles. Humble includes a bar code reader, a conveyor for receipt and transport of such purchase items, and a controller for selective movement of the conveyor. Humble is another tunnel type of checkout apparatus with external, manually operated scanner.

It is thus an object of the present invention to provide a checkout apparatus and method which automatically prices and bags purchase items.

It is another object of the present invention to provide such an apparatus and method which automatically identifies purchase items by type of purchase item and deposits the purchase items by type into bags which are designated by type.

It is still another object of the present invention to provide such an apparatus and method which prices and bags such items rapidly, reliably and efficiently.

It is finally an object of the present invention to provide such an apparatus which is inexpensive to manufacture and to operate.

SUMMARY OF THE INVENTION

The present invention accomplishes the above-stated objectives, as well as others, as may be determined by a fair reading and interpretation of the entire specification.

An apparatus is provided for pricing and bagging purchase items which are marked with bar codes, including a hub rotatably mounted on a hub mounting structure, a transparent and substantially horizontal upper table positioned over the lower table and rotatably mounted on the hub, the upper table having a circular array of purchase item delivery ports opening through the upper table, a transparent tray removably covering one of the purchase item delivery ports for receiving and retaining one purchase item, a motor for rotating the upper table on the hub, a bar code scanner positioned beneath the upper table and directed upward, a plurality of bags individually designated for specific types of purchase items and positioned below one of the delivery ports for selectively receiving the purchase item, a tray tilting mechanism for tilting the tray to drop the purchase item from the tray through the port beneath the tray into one of the bags, a microprocessor for controlling the operation of the motor to rotate the upper table to pass the purchase item over the scanner to read the price and classification of the purchase item, and then for operating the motor to rotate the purchase item to a position directly above one of the bags designated for receiving purchase items of the classification of the purchase item, and for operating the tray tilting mechanism to drop the purchase item off of the tray and through the port beneath the tray and into the particular designated bag, and to operating the tilting mechanism to replace the tray over the port.

The apparatus preferably additionally includes a lower table having a horizontal lower table upper surface and which is positioned below the upper table, the lower table having several bag holding chambers recessed into the lower table upper surface for removably retaining the bags, and having a structure for mounting the scanner means. The upper table is preferably annular in shape and mounted on several spokes leading to a rotatable hub, the hub being mechanically connected to the motor for rotation by the motor. Several purchase delivery funnels are preferably provided, one funnel being secured to the upper table beneath each port for guiding the purchase item as the purchase item drops into the bag. The tray tilting mechanism preferably includes a mechanical arm for gripping and tilting each tray. The scanner is preferably a multidirectional scanner which can read a bar code on a purchase item regardless of the rotational orientation of the bar code relative to the multidirectional scanner.

A method is provided of pricing and bagging purchase items marked with bar codes, using the above described apparatus, including the steps of rotating the upper table about the hub to sequentially present the tray to a purchaser, placing a purchase item into one of the trays, rotating the upper table to pass the purchase item over the scanner, transmitting information read from the bar code by the scanner to the microprocessor, rotating the upper table beyond the scanner to position the purchase item directly above the bag designated for the type of item indicated by the bar code, and moving the tray to drop the purchase item into the designated bag.

BRIEF DESCRIPTION OF THE DRAWINGS

Various other objects, advantages, and features of the invention will become apparent to those skilled in the art from the following discussion taken in conjunction with the following drawings, in which.

1.

2.

3.

4.

5.

6.

DETAILED DESCRIPTION OF THE PREFERRED EMBODIMENTS

Figure 1:
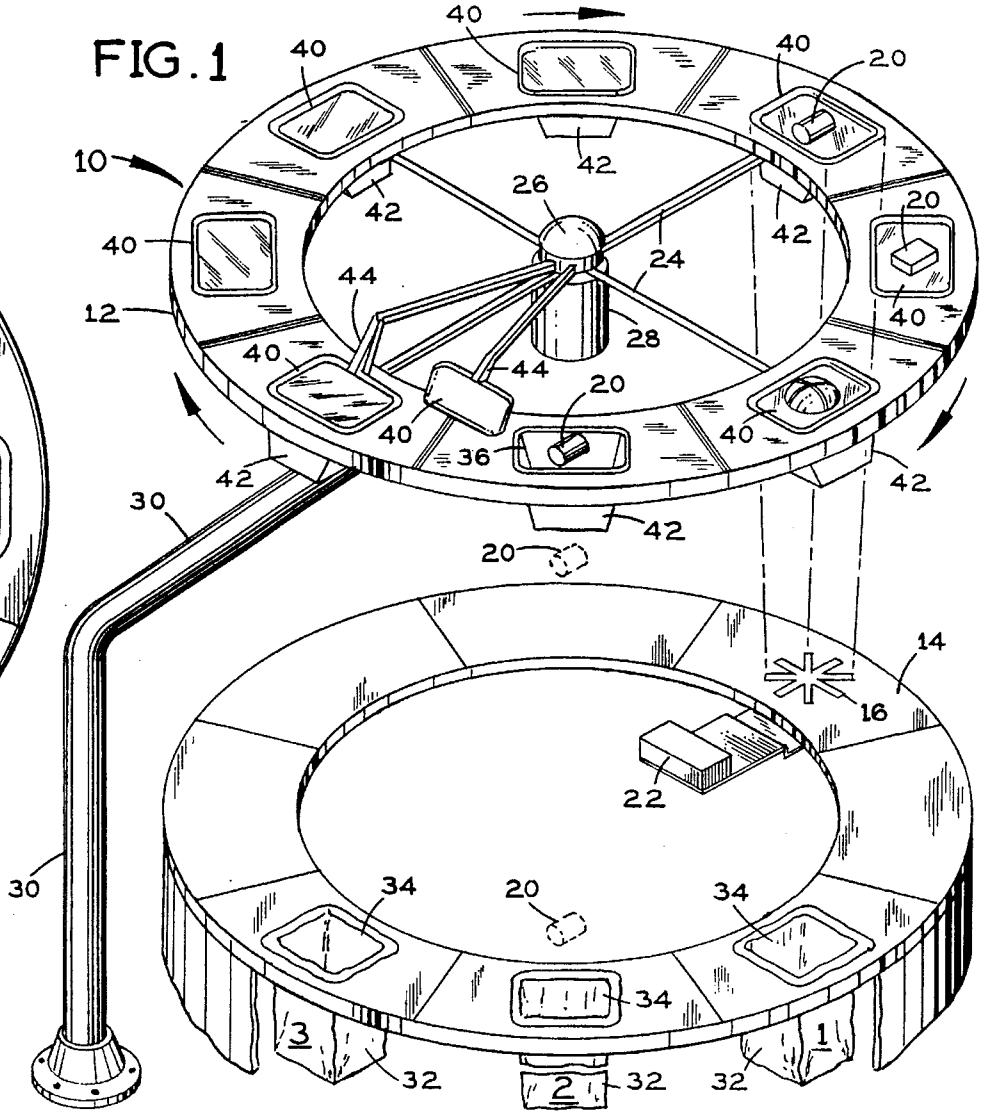
FIG. 1 is a perspective view of the inventive pricing and bagging checkout apparatus, showing the upper and lower tables, the direction of upper table rotation, and a purchase item falling into a designated carrying bag, the falling item being represented at various stages of its fall in broken lines. The spacing between the upper and lower tables is exaggerated for clarity.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various FIGURES are designated by the same reference numerals.

First Preferred Embodiment

Figure 2:
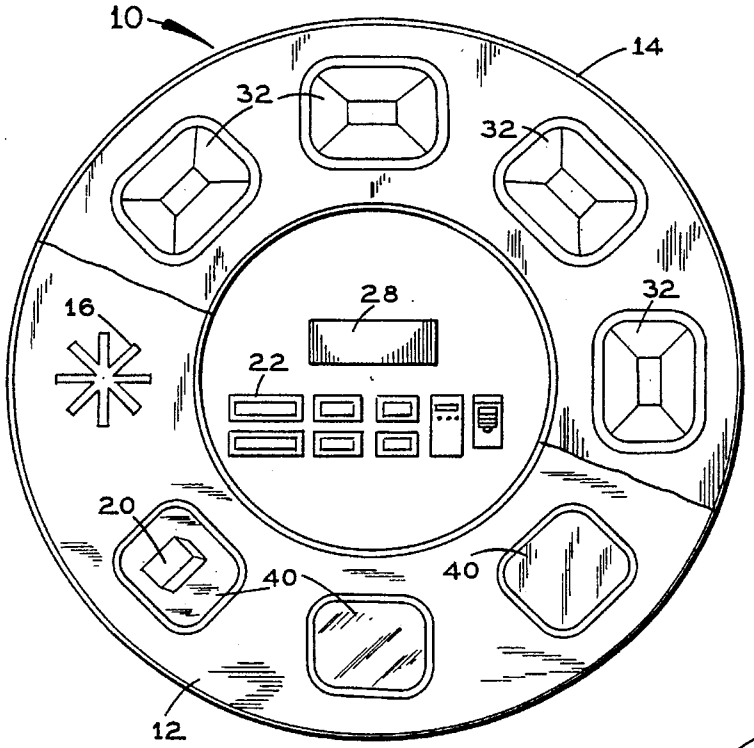
FIG. 2 is a schematic top view of the apparatus, the light annular area being part of the upper table, the remainder of which is broken away, and the darker annular area being part of the lower table.
Figure 3:
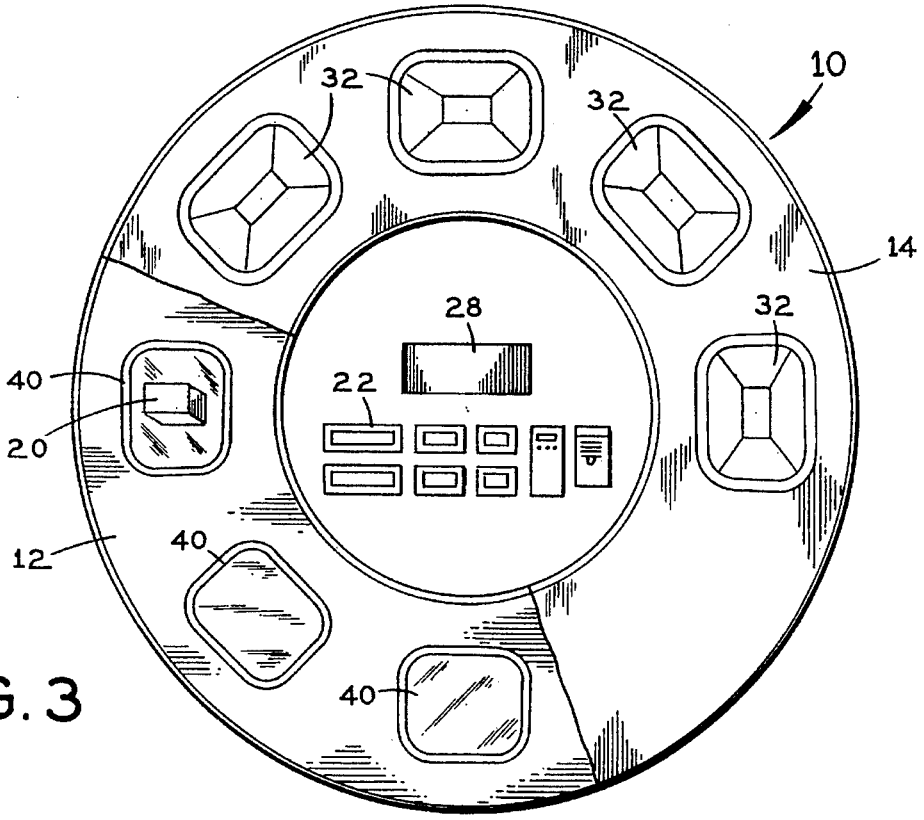
FIG. 3 is a view as in FIG. 2, but with the first purchase item rotated to a position above the scanner.
Figure 4:
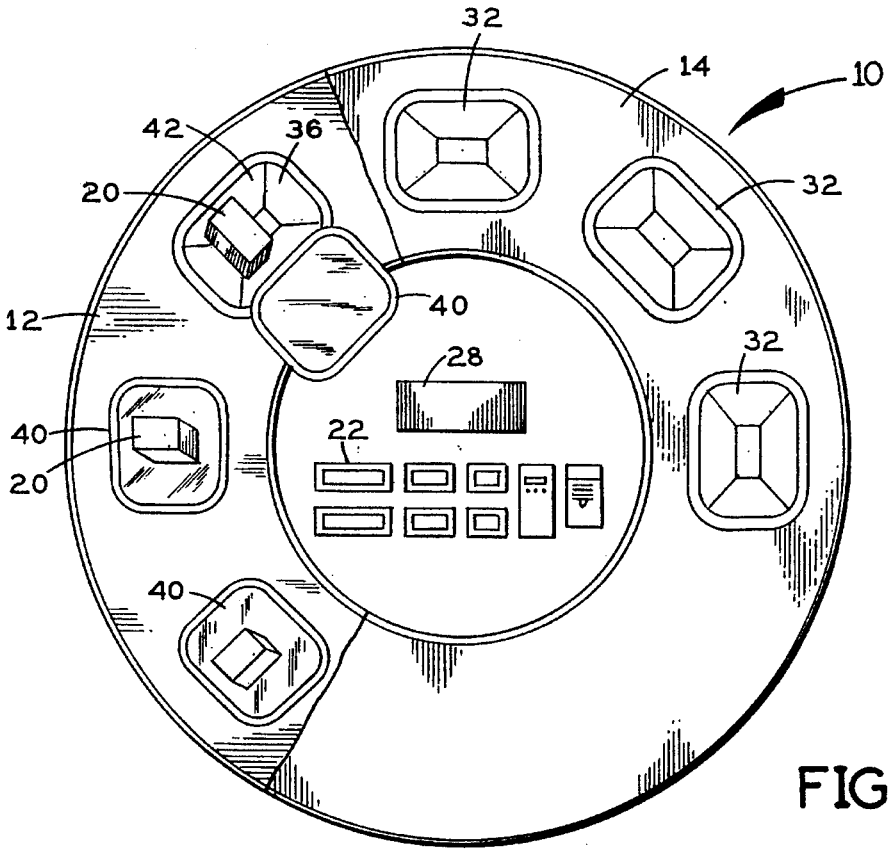
FIG. 4 is a view as in FIG. 3, but with the first purchase item rotated further to a position above a bag and the tray beneath the first purchase item being moved to drop the first purchase item into the designated bag below, and a second purchase item being positioned above the scanner, and a third purchase item being positioned to be rotated to the scanner after the second purchase item has advanced.
Figure 5:
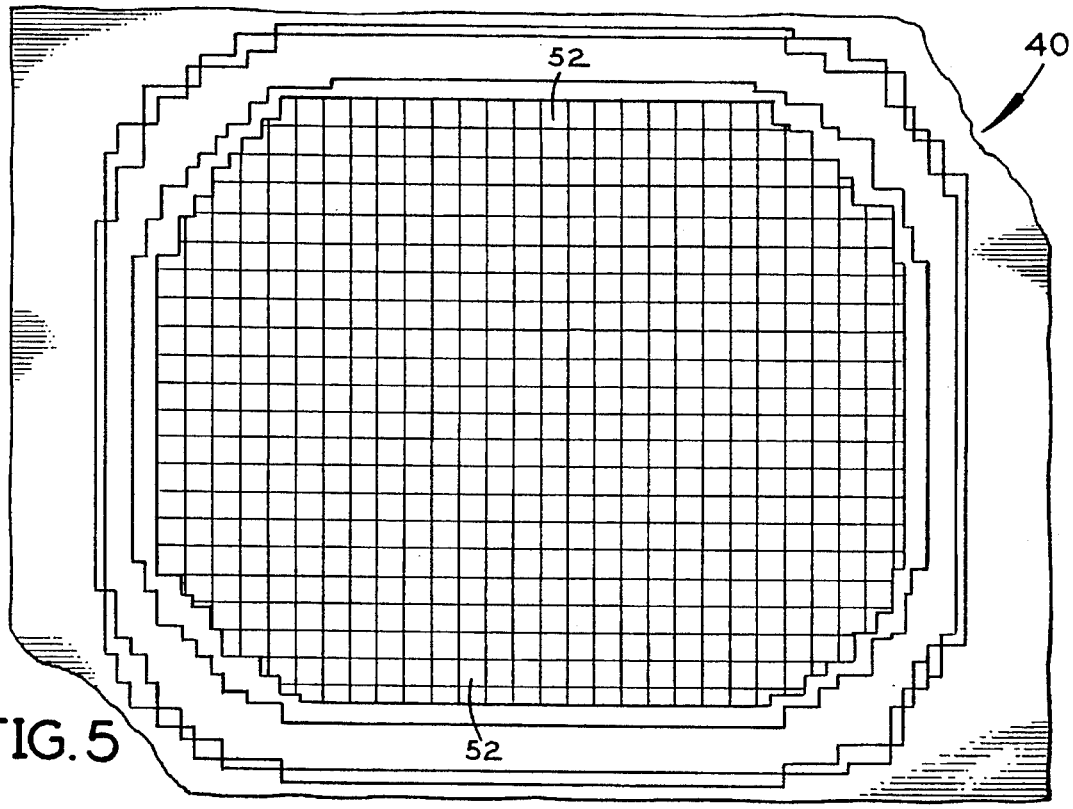
FIG. 5 is a top view of a tray equipped with the sensing cells.
Figure 6:
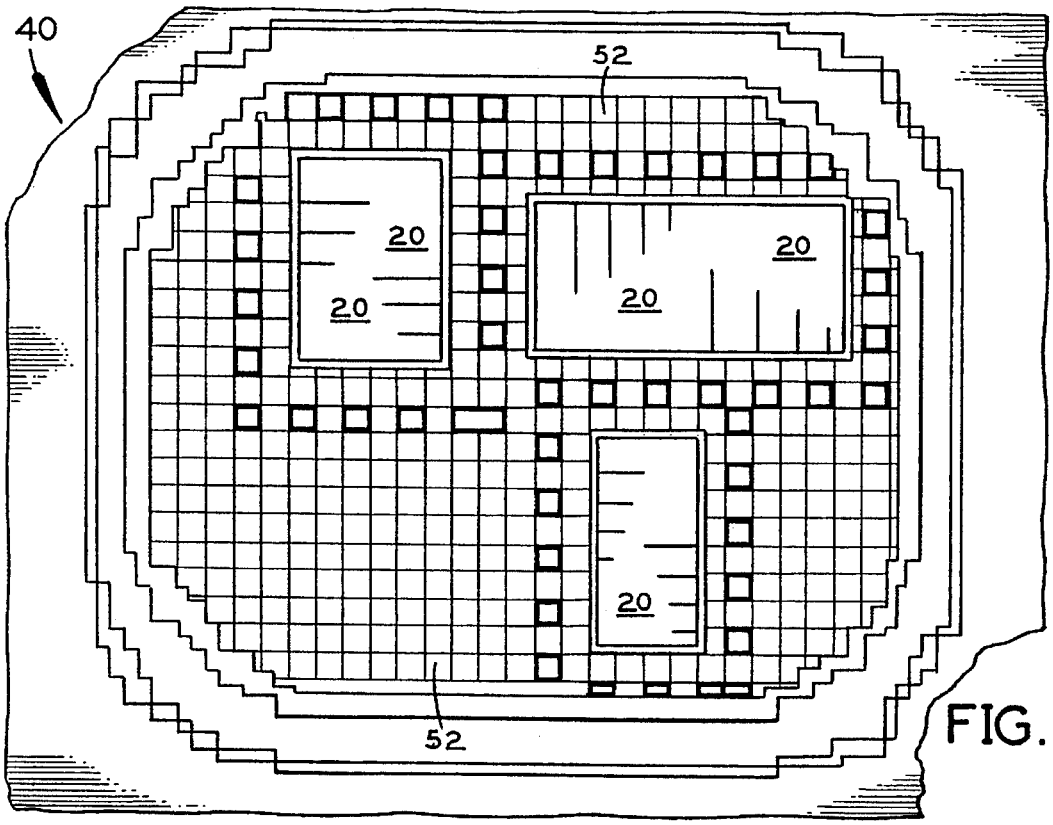
FIG. 6 is a view as in FIG. 5, but with three purchase items resting in the tray. The lighted cell border around each item is represented in series of dark blocks.

Referring to FIGS. 1–6, an automatic price reading and bagging apparatus 10 is disclosed for pricing and bagging purchase items 20 which are marked with bar codes. Apparatus 10 preferably includes a rotatable, annular upper table 12 and a fixed, circular lower table 14, a multi-directional scanner 16 and a microprocessor 22. Upper table 12 is horizontally mounted on spokes 24 leading to a rotatable hub 26 powered by an electric motor 28. See FIG. 1. Hub 26 is rotatably mounted on a hub support structure 30. Upper table 12 is positioned directly over lower table 14 and upper table 12 and lower table 14 have substantially equivalent outer diameters. Scanner 16 is mounted within lower table 14 directly below a segment of upper table 12, and upper table 12 is transparent so that scanner 16 rays pass through upper table 12 to read purchase item 20 bar codes. Open top chambers 32 are recessed periodically along the perimeter of lower table 14 and are each lined with a purchase carrying bag 34, shown as 34(1), 34(2) and 34(3). Each bag 34 is designated for a specific type of purchase item 20, such as frozen food, meats, heavy items such as canned goods, and so forth. Purchase item ports 36 opening into purchase item 20 delivery funnels 42 are provided periodically along the perimeter of upper table 12 for delivering individual purchase items 20 into purchase carrying bags 34. A transparent tray 40 covers each port 36 and each tray 40 is removable from and tiltable over the given port 36 with a mechanical arm 44 extending from hub 26, or by equivalent tray 40 moving means.

Method

In practicing the invention, the following method may be used. Upper table 12 is rotated on hub 26 by motor 28, which is operated by microprocessor 22. A single purchase item 20 which has been marked with scanner bar code (not shown) is placed into each tray 40 by a purchaser as upper table 12 rotates and sequentially presents trays 40 to the purchaser. See FIG. 2. Upper table 12 is rotated to pass the given purchase item 20 over multidirectional scanner 16. See FIG. 3. Scanner 16 reads the price and description of the item 20 and transmits this information to micro-processor 22. Upper table 12 is rotated further, beyond scanner 16 and over one of the series of purchase carrying bags 34. Micro-processor 22 uses the scanned information about the purchase item 20 to select which bag 34 the given purchase item 20 should enter, and switches power to electric motor 28 to rotate upper table 12 a sufficient number of degrees to place the given purchase item 20 directly above the purchase carrying bag 34 designated for the given type of item 20. Then tray 40 is lifted and tilted by mechanical arm 44 or other equivalent means to drop the given purchase item 20 through the port 36 beneath the item 20 and into the appropriate carrying bag 34. See FIGS. 1 and 4. This process is continued until all purchase items 20 for a given purchaser are priced and appropriately bagged. The purchaser has no access to anything beyond the tray 40 which is presented to him for loading. Reference is made to the parent application, Ser. No. 08/241,354.

Multiple purchase items 20 may be placed on a single tray 40 simultaneously as long as they are of the same type so that they can be deposited together into a single designated bag 34. In this instance, trays 40 are each preferably made of transparent cells 52 that are sensitive to the placement of any purchase item 20 on their upper surfaces. See FIG. 5. As soon as the item 20 is placed upon the tray 40, cells 52 below the item 20 as well as cells in contact with the perimeter of item 20 are activated to turn a bright color, such as red. See FIG. 6. The placement of another item 20 upon the activated cells 52 around the first item 20 will result in the activation of a buzzer or similar device to indicate that the placement is improper. Microprocessor 22 detects this improper placement and does not permit upper table 12 to rotationally advance. This feature prevents items 20 from being placed too close together on a given tray 40 for their bar codes to be isolated and read by the scanner 16.

A scale may also be provided in table 12 to weigh an item 20 where the price of item 20 is determined by such a measurement. This information is relayed to the microprocessor 22 where the price is calculated and recorded.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim as my invention:

1. An apparatus for pricing and bagging purchase items which are marked with bar codes, comprising:

hub means rotatably mounted on a hub mounting structure, a transparent and substantially horizontal upper table positioned over item bag holding means and rotatably mounted on said hub means, said upper table having a circular array of purchase item delivery ports opening through said upper table, a transparent tray removably covering said purchase item delivery ports for receiving and retaining one said purchase item, motor means for rotating said upper table on said hub means, scanner means positioned beneath said upper table and directed upward, a plurality of bags individually designated for specific types of purchase items and positioned below one of said delivery ports for selectively receiving said purchase item, tray tilting means for tilting said tray to drop said purchase item from said tray through the port beneath said tray into one of said bags, a microprocessor for controlling the operation of said motor means to rotate said upper table to pass said purchase item over said scanner means to read the price and classification of said purchase item, and then for operating said motor means to rotate said purchase item to a position directly above one of said bags designated for receiving purchase items of the classification of said purchase item, and for operating said tray tilting means to drop said purchase item off said tray and through the port beneath said tray and into said one of said bags, and to replace said tray over said port.

2. The apparatus of claim 1, wherein said item bag holding means comprises:

a lower table having a lower table upper surface and being positioned below said upper table, said lower table having a plurality of bag holding chambers recessed into said lower table upper surface for removably retaining said bags, and having means for mounting said scanner means.

3. The apparatus of claim 1, wherein said upper table is annular in shape and mounted on a plurality of spokes leading to said rotatable hub means, said hub means being mechanically connected to said motor means for rotation by said motor means.

4. The apparatus of claim 1, additionally comprising a plurality of purchase delivery funnels, one said funnel being secured to said upper table beneath each said port for guiding said purchase item as said purchase item drops from said tray into said bag.

5. The apparatus of claim 1, wherein said tray tilting means comprises:

a mechanical arm for gripping and tilting each said tray.

6. The apparatus of claim 1, wherein said scanner means a multidirectional scanner which can read a bar code on a purchase item regardless of the rotational orientation of the bar code relative to said multidirectional scanner.

7. A method of pricing and bagging purchase items marked with bar codes, using an apparatus comprising hub means rotatably mounted on a hub mounting structure, a transparent and substantially horizontal upper table positioned over item bag holding means and rotatably mounted on said hub means, said upper table having a circular array of purchase item delivery ports opening through said upper table, a transparent tray removably covering at least one said purchase item delivery ports for receiving and retaining one said purchase item, motor means for rotating said upper table on said hub, scanner means positioned beneath said upper table and directed upward, a plurality of bags individually designated for specific types of purchase items and positioned below one of said delivery ports for selectively receiving said purchase item, tray tilting means for tilting said tray to drop said purchase item from said tray through the port beneath said tray into one of said bags, a microprocessor for controlling the operation of said motor means to rotate said upper table to pass said purchase item over said scanner means to read the price and classification of said purchase item, and then for operating said motor means to rotate said purchase item to a position directly above one of said bags designated for receiving purchase items of the classification of said purchase item, and for operating said tray tilting means to drop said purchase item off said tray and through the port beneath said tray and into said one of said bags, and to replace said tray over said port, comprising the steps of:

rotating said upper table about said hub means to sequentially present said tray to a purchaser, placing a purchase item into one said tray, rotating said upper table to pass said purchase item over said scanner means, transmitting information read from said bar code by said scanner means to said microprocessor, rotating said upper table beyond said scanner means to position said purchase item directly above the bag designated for the type of item indicated by said bar code, moving said tray to drop said purchase item into the designated bag.

* * * * *